US010962272B2

(12) United States Patent
MokhtarzadehBahadorani

(10) Patent No.: US 10,962,272 B2
(45) Date of Patent: Mar. 30, 2021

(54) THERMAL INSULATION BOX WITH COOLING MECHANISM

(71) Applicant: TCP RELIABLE, INC., Edison, NJ (US)

(72) Inventor: Nima MokhtarzadehBahadorani, Montreal (CA)

(73) Assignee: TCP Reliable, Inc., Edison, NJ (US)

( * ) Notice: Subject to any disclaimer, the term of this patent is extended or adjusted under 35 U.S.C. 154(b) by 181 days.

(21) Appl. No.: 16/212,456

(22) Filed: Dec. 6, 2018

(65) Prior Publication Data

US 2020/0182527 A1 Jun. 11, 2020

(51) Int. Cl.

| | |
|---|---|
| ***F25D 3/10*** | (2006.01) |
| ***B65D 81/38*** | (2006.01) |
| ***B65D 81/18*** | (2006.01) |
| ***F25D 29/00*** | (2006.01) |

(52) U.S. Cl.

CPC ..... *F25D 3/107* (2013.01); *B65D 81/18* (2013.01); *B65D 81/3816* (2013.01); *F25D 29/005* (2013.01)

(58) Field of Classification Search

CPC ..... F25D 11/003; F25D 11/006; F25D 3/105; F25D 3/107; F25D 3/102; F25D 29/005; F25D 2400/36; B65D 81/38; B65D 5/5233; B65D 81/3862

See application file for complete search history.

(56) References Cited

U.S. PATENT DOCUMENTS

| | | | | |
|---|---|---|---|---|
| 3,257,820 A * | 6/1966 | Case | F25D 3/105 62/223 |
| 6,158,227 A * | 12/2000 | Seeley | G01K 1/14 340/585 |
| 6,409,568 B1 * | 6/2002 | Søgaard et al. | B65D 5/4204 446/73 |
| 6,968,711 B2 * | 11/2005 | Smith | C09K 5/047 62/371 |

(Continued)

FOREIGN PATENT DOCUMENTS

| | | | |
|---|---|---|---|
| CN | 101415622 A * | 4/2009 | B65D 81/3862 |
| CN | 104251582 A * | 12/2014 | |

(Continued)

OTHER PUBLICATIONS

Protecting Perishable Foods, USDA (Year: 2008).*

*Primary Examiner* — Nelson J Nieves
(74) *Attorney, Agent, or Firm* — Eric P. Mirabel

(57) ABSTRACT

The invention relates to a smart thermal insulation box, including thermally insulated layers with mitered edges forming a thermally insulated space, and said space surrounded by cardboard material. The box has externally viewable and operable temperature and humidity sensors, where the sensors are preferably fixed inside the box to one side. The temperature monitoring system monitors temperature of the insulated space and facilitates delivery of refrigerant into it through a refrigerant delivery system when the temperature of insulated space exceeds a set value. One of the cardboard panels forming the top of the box which overlays the insulation layer has a window configured to overlay the display panel. An audible alert system may also be included to alert users to temperature or humidity excursions.

9 Claims, 8 Drawing Sheets

(56) References Cited

U.S. PATENT DOCUMENTS 8,887,515 B2 * 11/2014 Patstone ..... B23P 15/26 62/56
9,792,748 B2 * 10/2017 Campalans ..... B65D 81/2076
9,976,782 B1 * 5/2018 Holzwanger ..... F25D 17/02
2004/0055313 A1 * 3/2004 Navedo ..... F25D 11/003 62/6
2006/0230778 A1 * 10/2006 Williams ..... B65D 81/3862 62/371
2008/0208158 A1 * 8/2008 Goodman ..... B65D 81/3862 604/408
2009/0078699 A1 * 3/2009 Mustafa ..... B65D 81/3862 220/1.5
2009/0095798 A1 * 4/2009 Senftner ..... B65D 81/3862 229/103.11
2009/0314677 A1 * 12/2009 Teggatz ..... A45C 15/06 206/457
2013/0008182 A1 * 1/2013 Hrudka ..... F25B 21/04 62/3.6
2013/0082044 A1 * 4/2013 Doan ..... H05B 6/6426 219/387
2014/0054300 A1 * 2/2014 Gilpatrick ..... B32B 29/08 220/592.16
2014/0260111 A1 * 9/2014 Phillips ..... F25D 3/08 53/475
2014/0334517 A1 * 11/2014 Blundell ..... G01J 5/046 374/44
2014/0338390 A1 * 11/2014 Pinto ..... F25D 11/006 62/441
2016/0025401 A1 * 1/2016 Chaparro ..... F25D 3/102 62/373
2016/0068293 A1 * 3/2016 Cutting ..... A61J 1/10 53/432
2016/0178252 A1 * 6/2016 Nakamura ..... F25B 21/04 62/3.3
2017/0001785 A1 * 1/2017 Ripley ..... F25D 17/02
2017/0023290 A1 * 1/2017 Demuth ..... F25D 25/022
2017/0321947 A1 * 11/2017 Zvida ..... F25D 29/003
2018/0274843 A1 * 9/2018 Lombardo ..... F25D 3/06

FOREIGN PATENT DOCUMENTS

CN 105737471 A * 7/2016 ..... B65D 81/3862
CN 105857931 A * 8/2016 ..... B65D 81/3862
CN 105865116 A * 8/2016
CN 106516446 A * 3/2017
CN 106697597 A * 5/2017 ..... F25D 11/006
CN 107178946 A * 9/2017
CN 108082656 A * 5/2018
WO WO-2015014417 A1 * 2/2015 ..... F25B 21/04

* cited by examiner

THERMAL INSULATION BOX WITH COOLING MECHANISM

BACKGROUND

Shipment of pharmaceuticals, blood, organs and other biological materials is problematic because of their short effective life, and high value. In general, insulated containers in combination with temperature-control agents, such as refrigerant materials or phase change materials, are widely used as a cost-effective system to maintain the temperature of shipped products below room temperature and at selected temperature ranges. See, e.g., U.S. Pat. Nos. 7,849,708; 7,294,374 and 8,375,730 (all of which are incorporated by reference).

Time in shipment can only be estimated, as there are many sources of delay during shipment, both conventional and unexpected. Also, the temperature during shipment can only be estimated based on expected weather conditions and knowledge of temperatures of the shipment mode and warehouses where the shipment is stored. Unexpected delays and temperature/humidity variations are more frequent as shipping routes become longer, especially where shipping routes become global—which is increasingly the case in the pharmaceutical, vaccine, blood and organ donation field.

If a shipment of such pharmaceutical or biological products is delayed, and/or the temperature increases beyond expectation during shipment for more than a prescribed period, the products may become unusable. Also, for blood or biological products, it is also important to have after-shipment verification of appropriate shipping conditions (esp. temperature, humidity, pH) for regulatory compliance purposes, for both the recipient and the shipper. Thus, what is needed is a cost-effective system to cool the cargo during shipment, if the internal temperature becomes too high for too long.

SUMMARY

The invention relates to a smart thermal insulation box with externally viewable values of temperature, humidity and, optionally, vibration of its contents, and which facilitates automatic control for internal cooling of the contents. One embodiment includes an inner insulator box made of panels of thermal insulation material and an outer cardboard box covering the insulator box, which is preferably formed of expanded polystyrene ("EPS"). The outer cardboard box is preferably made of corrugated cardboard, or, optionally, corrugated plastic sheets, e.g., those manufactured by Coroplast (Quebec, Canada), or wood, metal or another suitable material for protection of the EPS insulation.

The inner insulator box includes four wall panels and, preferably, two adjoining panels forming each of the top and bottom. All panels (both wall and adjoining panels) have mating mitered edges so as to form a well-insulated cargo space within the inner insulator box. All embodiments of parent U.S. application Ser. No. 16/212,423 are suitable for use with the invention, as modified by the addition of the refrigerant delivery system described herein.

The inner insulator box includes a temperature monitoring system having an assembly of sensors, electronic circuitry and a display screen to display values of temperature, humidity and vibration of the internal space and its contents. While the temperature, humidity and vibrations sensors are preferably installed on a single sensor pad which is fixed on inside the inner insulator box, the electronic circuitry and the display screen is embedded on one of the adjoining panels or the wall panels in a manner such that the display screen remains visible (through either an opening or a transparent window in the cardboard box cover) from the outside of the insulator box. The inner insulator box further includes the refrigerant delivery system installed on a side tray attached externally to one of its wall panels, which is also housed within the outer cardboard box.

The refrigerant delivery system is controlled by the temperature monitoring system. When the internal temperature exceeds a threshold for longer than a specified time, the temperature monitoring system triggers a microprocessor to cause the refrigerant delivery system to release refrigerant into the internal space. The real-time change in temperature can be seen on the display screen.

It should be understood that the drawings and their associated descriptions below are intended and provided to illustrate one or more embodiments of the present invention, and not to limit the scope of the invention. Also, it should be noted that the drawings are not be necessarily drawn to scale.

DETAILED DESCRIPTION

Figure 1:
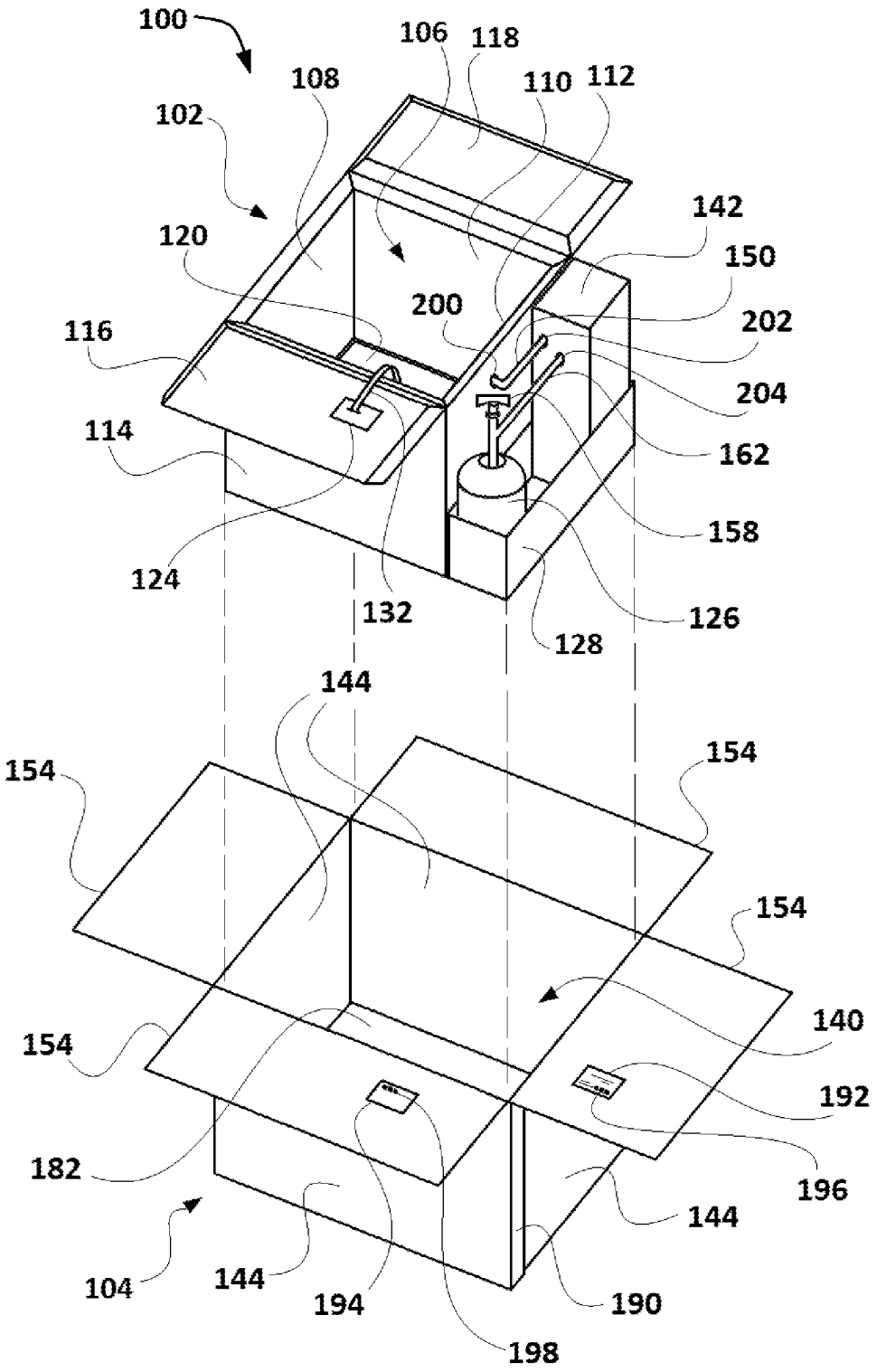
FIG. 1 illustrates a perspective exploded view of a smart thermal insulation box in accordance with a first embodiment of the present invention.
Figures 2A, 2B:
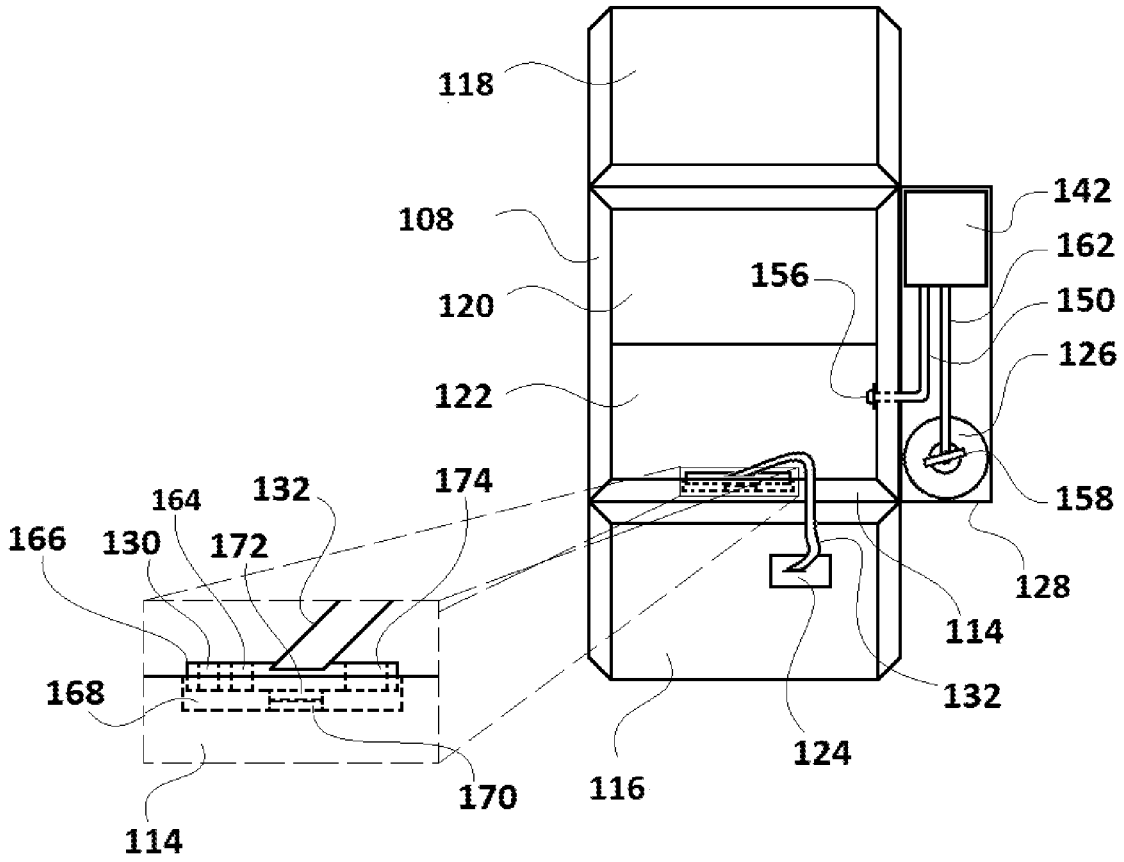
FIG. 2A illustrates a plan view of the inner insulator box in accordance with a first embodiment of the present invention.
FIG. 2B illustrates a magnified view of a portion of plan view of FIG. 2A.
Figure 3:
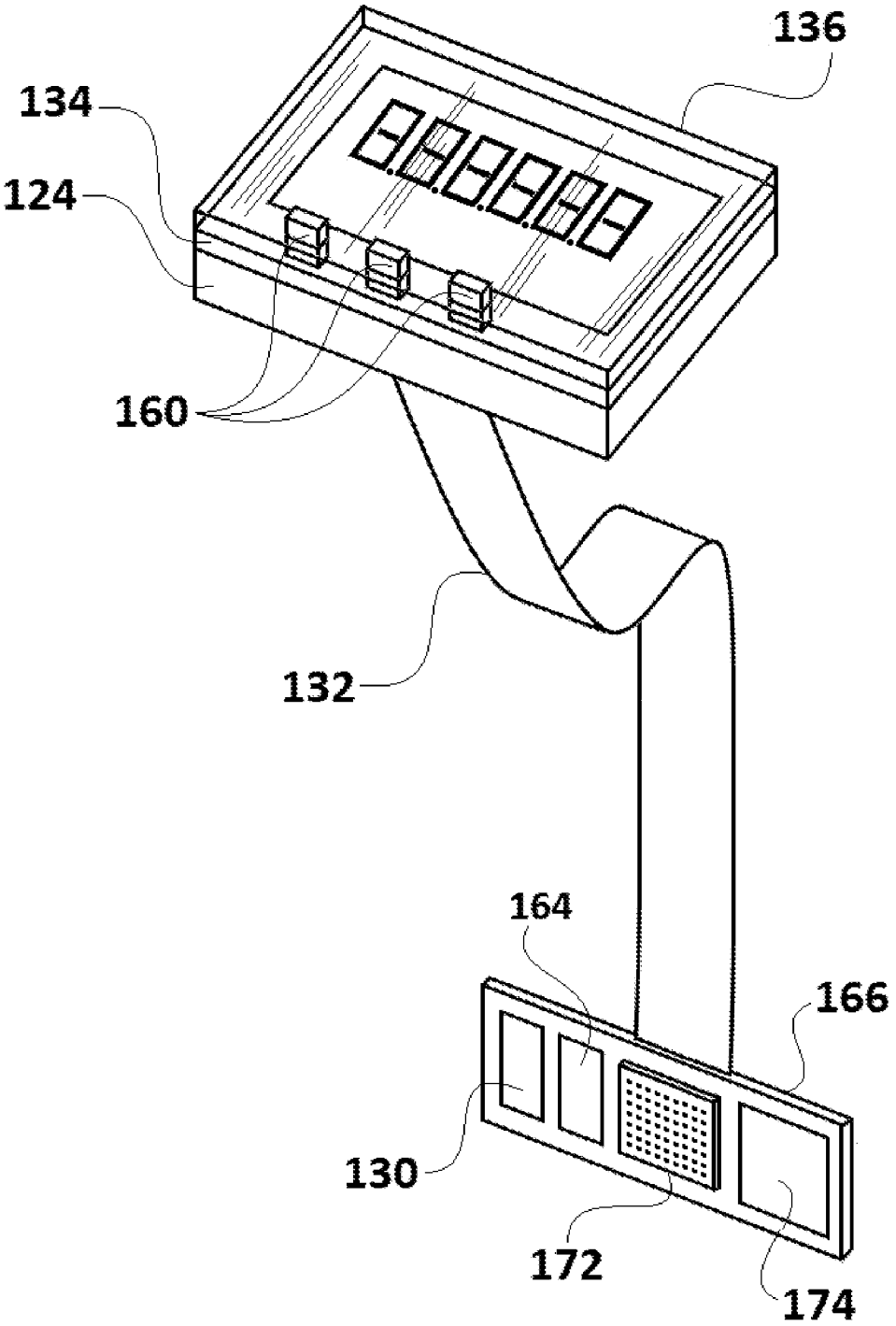
FIG. 3 illustrates a perspective view of a processor board, display screen and sensors for use in the invention.
Figure 4A:
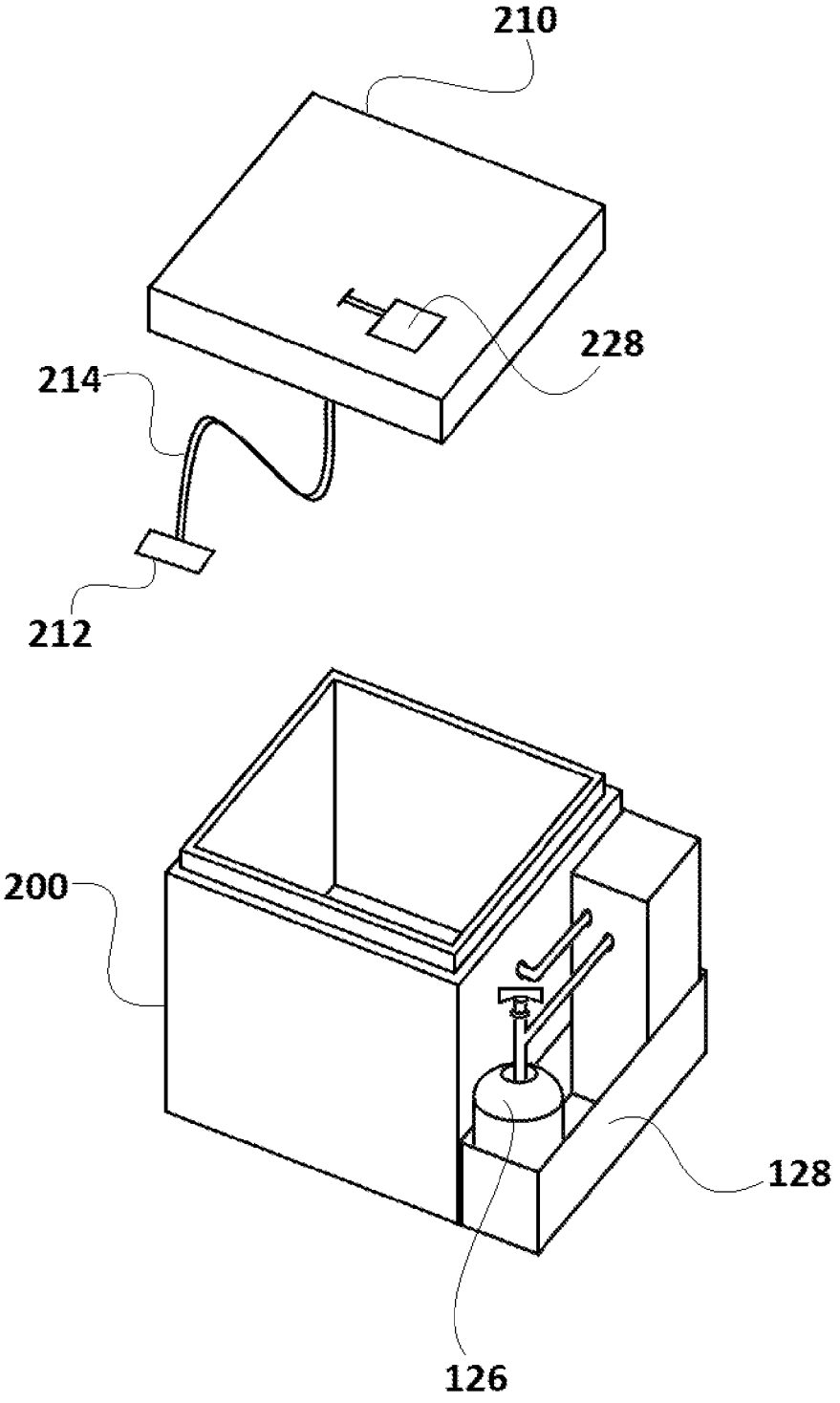
FIG. 4A is an exploded view of an additional embodiment of the inner insulating portion of smart thermal insulation box.
Figure 4B:
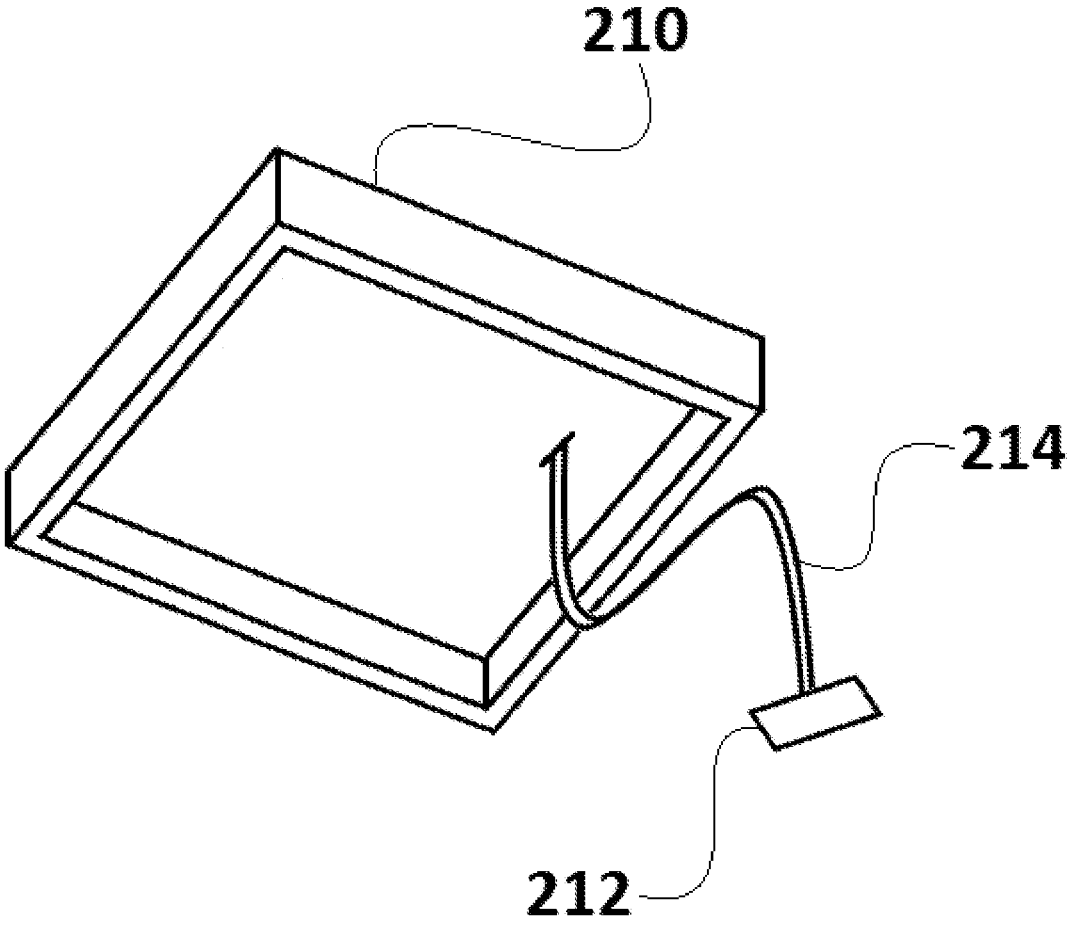
FIG. 4B shows the underside of the lid of the inner insulating portion of smart thermal insulation box shown in FIG. 4A.

Reference will now be made in detail to a first embodiment of a smart thermal insulation box of the invention with reference to the accompanying FIGS. 1 to 3. Smart thermal insulation box 100 includes an inner insulator box 102 and an outer cardboard box 104. Inner insulator box 102 is made of panels of thermal insulation material (preferably EPS) mating along mitered edges. In a fully assembled and packed state of the box 102, its internal space 106 is surrounded by walls 108, 110, 112, 114, and flaps 116, 118, 120 and 122. While flaps 116 and 118 form the upper cover of the internal space 106 (and inner insulator box 102), flaps 120 and 122 form the lower covers. Flaps 120 and 122, and flaps 116 and 118, mate along their mitered edges in the middle of box 102. In the illustration of FIG. 1, flaps 120 and 122 are closed to form lower cover of inner insulator box 102. In FIG. 1, flap 120 remains partially visible and flap 122 remains completely hidden. All walls and flaps of inner insulator box 102 mate with corresponding mitered edges of one or more adjacent panels to form a well thermally-insulated internal space 106.

The inner insulator box 102 also includes a temperature, humidity and vibration monitoring system (including assembly of sensors, electronic circuitry and a display screen to display values of temperature, humidity and vibration of box 102 and its contents). Sensor pad 166, holding the temperature, humidity and vibration monitoring sensors, is connected to processor board 124 using a multi-conductor ribbon cable 132, to form the monitoring system.

Inner insulator box 102 further includes side tray 128 which is attached to the outer side of wall 112. Inside side tray 128 is refrigerant can 126 (containing a compressed refrigerant, e.g., R22) and valve control 142. Refrigerant can 126 and valve control 142 are connected by a thermally insulated release tube 162. Valve 158 can be opened and set to release of a pre-selected quantity of pressurized refrigerant per unit time from the refrigerant can 126 into the release tube 162. The valve control 142 is also connected to the internal space 106 through a spray nozzle 156 of thermally insulated spray tube 150. While one end of spray tube 150 lies within the internal space 106, its other end is connected through valve control 142 to release tube 162 such that valve control 142 permits flow or hold of pressurised cooling refrigerant from release tube 162 (supplied by refrigerant can 126) into spray tube 150.

Valve control 142 and valve 158 are controlled by the temperature monitoring system. Valve control 142 further includes all associated circuitry and a power source (preferably a +9V DC battery), as needed to communicate with the temperature monitoring system and operate valves 142 and 158 based on instructions received from it. When valve control 142 is opened along with opening valve 158, pressurized refrigerant fluid in can 126 is released into release tube 162 and expands and gasifies, causing cooling of the refrigerant fluid in release tube 162. The cooled refrigerant fluid flows from release tube 162 through valve control 142 and into spray tube 150, and then into internal space 106 through spray nozzle 156. Spray nozzle 156 facilitates even distribution of the refrigerant gas stream into internal space 106, and enhances uniform cooling of internal space 106 (and the cargo).

To isolate internal space 106 from external surroundings and prevent leakage of refrigerant from the internal space 106 into the external surroundings, gaps between spray tube 150 (along aperture 200) and wall 112 are preferably sealed with a sealant (such as silicone rubber). Similarly, isolation of the valve control 142 is achieved by sealing gaps in aperture 202 and 204 which provide access passage for release tube 162 and spray tube 150 into and from the valve control 142.

The temperature, humidity and vibrations sensors are preferably installed on a single sensor pad 166 which is preferably fixed on inside the inner insulator box 102. Apart from temperature sensor 130, humidity sensor 164, and vibration sensor 174, sensor pad 166 further includes Velcro pad 172 with one portion of a hook and loop fastener. Sensor pad 166 is fixed to a mating Velcro pad 170, with the mating portion of a hook and loop fastener, where Velcro pad 170 is installed in a recess 168 (shown in the magnified view of FIG. 2B) of inner surface of wall 114. FIG. 1 shows the underside of embedded processor board 124 included in flap 116. As noted, embedded processor board 124 is connected to sensor pad 166 through multi-conductor ribbon cable 132 as shown in FIG. 3.

Processor board 124 includes a cover for, preferably, a seven segment type LCD or LED display screen 134 for displaying the units of temperature, humidity and vibrations detected by sensors 130, 164, and 174 respectively. A beeper (not illustrated) is also preferably included in processor board 124 for providing audible alarms. Operation of both display screen 134 and the beeper are controlled by processor board 124. A preferred seven-segment display for screen 134 is shown in FIG. 3 for the purpose of illustration; however, based on requirements, the count and layout of the segment units of the display screen 134 may vary. Processor board 124 further includes a microprocessor, a memory and associated circuitry on a circuit board, for:

i) measuring the outputs received from sensors 130, 164, and 174 and displaying of temperature and humidity on the display screen 134, ii) Controlling the operations of release valve 158 and valve control 142 on the basis of the measured temperature within internal space 106, and iii) presenting records and averages and other analysis of temperature, humidity and vibration values previously recorded.

For user control of processor board 124 and display screen 134 (to request temperature-humidity records, or averages over time periods) and to power it on or off as and when required, processor board 124 includes user input keys 160. Processor board 124, optionally, further includes transceiver and GPS circuitry for wirelessly communicating data and location information to a remote server. Technology and circuitry for performing the functions of processor board 124 are well known, as shown e.g., in U.S. Pat. Nos. 9,835,501; 8,935,934 (all incorporated by reference). Still further, for powering processor board 124, a DC battery (not shown) preferably, a +9V DC battery, is also included.

When powered-on, processor board 124 receives sensed temperature and humidity inputs from sensors 130 and 164 respectively, processes and measures them, and displays the measured temperature and humidity on display screen 134. Additionally, processor board 124 also checks whether the measured temperature of the internal space 106 (and hence its contents) exceeds a threshold for an unacceptably extended period. If it does, processor board 124 instructs (which is directly connected or wirelessly controlled) operation of release valve 158 and valve control 142 to release refrigerant fluid into the internal space 106. It is to be noted that in powered-off state of the processor board 124, release valve 158 and valve control 142 remain closed. For protection against ingression of dust, water or other fluid, a transparent cover 136 (preferably, clear plastic) covers display screen 134.

In a fully packed state of smart thermal insulation box 100, insulator box 102 fits within the internal space 140 of the outer cardboard box 104. In a fully assembled and packed state of the cardboard box 104, its internal space 140 is surrounded by four walls 144, four upper flaps 154 and four lower flaps 182 (a partial view of one of the lower flaps 182 is seen in FIG. 1). The upper flaps 154 form the upper cover of the outer cardboard box 104. Similarly, the lower flaps 182 form the lower cover of the outer cardboard box 104.

Still further, a extension flap strip 190 attached to first of the walls 144 adheres to the outer side of the fourth of the walls 144 near the edge to maintain box 104 in assembly. Two of the upper flaps 154 further include transparent "see-through" window slabs 192 and 194. When these flaps are folded, window slabs 192 and 194 overlay display screen 134 and cover 136. Slabs 192 and 194 facilitate unrestricted view of display screen 134. They further include coinciding aperture sets 196 and 198 respectively. In a fully packed state of the smart thermal insulation box 100, the aperture sets 196 and 194 facilitate protrusion of keys 160 from the outer cardboard box 104. This obviates the need of opening the outer cardboard box 104 for operating the processor board 124.

In a preferred mode of operation, before placing a temperature (and/or humidity) sensitive cargo within inner insulator box 102, processor board 124 is turned off, and flaps 120 and 122 are folded in to form the lower support. Sensor pad 166 is then placed within recess 168 by attaching Velcro pad 172 to the Velcro pad 170 (illustrated in magnified view of FIG. 2). A cargo is loaded into box 102, and empty space within internal space 106 is preferably filled with filler material, (more preferably, insulating filler materials including, additional EPS or other foam insulation material, cardboard or paper, loose fill material or other materials) to keep cargo stable during transit and to enhance insulation. Thereafter, inner insulator box 102 is sealed by folding top flaps 116 and 118 in and preferably wrapping with adhesive tape.

Based on the contents of the inner insulator box 102, the valves 142 and 158 may be set to permit a preselected flow quantity of refrigerant fluid per unit time when instructed by the processor board 124. Thereafter box 102 is placed within outer cardboard box 104, and its lower flaps 182 are folded in and sealed with adhesive tape. Thereafter the upper flaps 154 of outer cardboard box 104 are folded in a manner to ensure that keys 160 of the processor board protrude through the apertures 196 and 198. Finally, the outer cardboard box 104 is sealed with an adhesive tape and keys 160 are operated to turn-on processor board 124. Once the processor board 124 is powered on, its operated either automatically or by user keys 160 to monitor temperature of the cargo (and/or the humidity and vibrations within the internal space 106) at pre-set time intervals. In case the that temperature of the cargo or humidity breaches tolerable higher limits, the beeper produces an audible alarm, and a suitable dose of the cooling refrigerant is automatically sprayed within the internal space 106 on wireless instructions of the processor board 124 to the valves 142 and 158. This brings down the temperature of the contents of internal space 106. Further, if needed the box 100 may be opened and the cargo (or the internal space 106) may be treated suitably to bring monitored temperature (and/or humidity) to acceptable levels. The beeper may be muted manually as and when required, or may be programmed suitably for adjusting magnitude and timings of audible alarm through keys 160. FIGS. 4A to 5C show another embodiment of a smart thermal insulation box, where the insulating components (made of insulating material, preferably "EPS") are in two pieces: a body 200 with a lid 210. Processor board 228 receives input from monitor temperature, humidity and vibration sensors (incorporated in sensor pad 212), by connection through ribbon cable 214. Processor board 228 provides visible display of temperature, humidity and vibration, similar to processor board 128. Body 200 includes the same side tray 128, with the same other parts therein as the first embodiment, described above and shown in FIGS. 1 and 2.

Figure 5A:
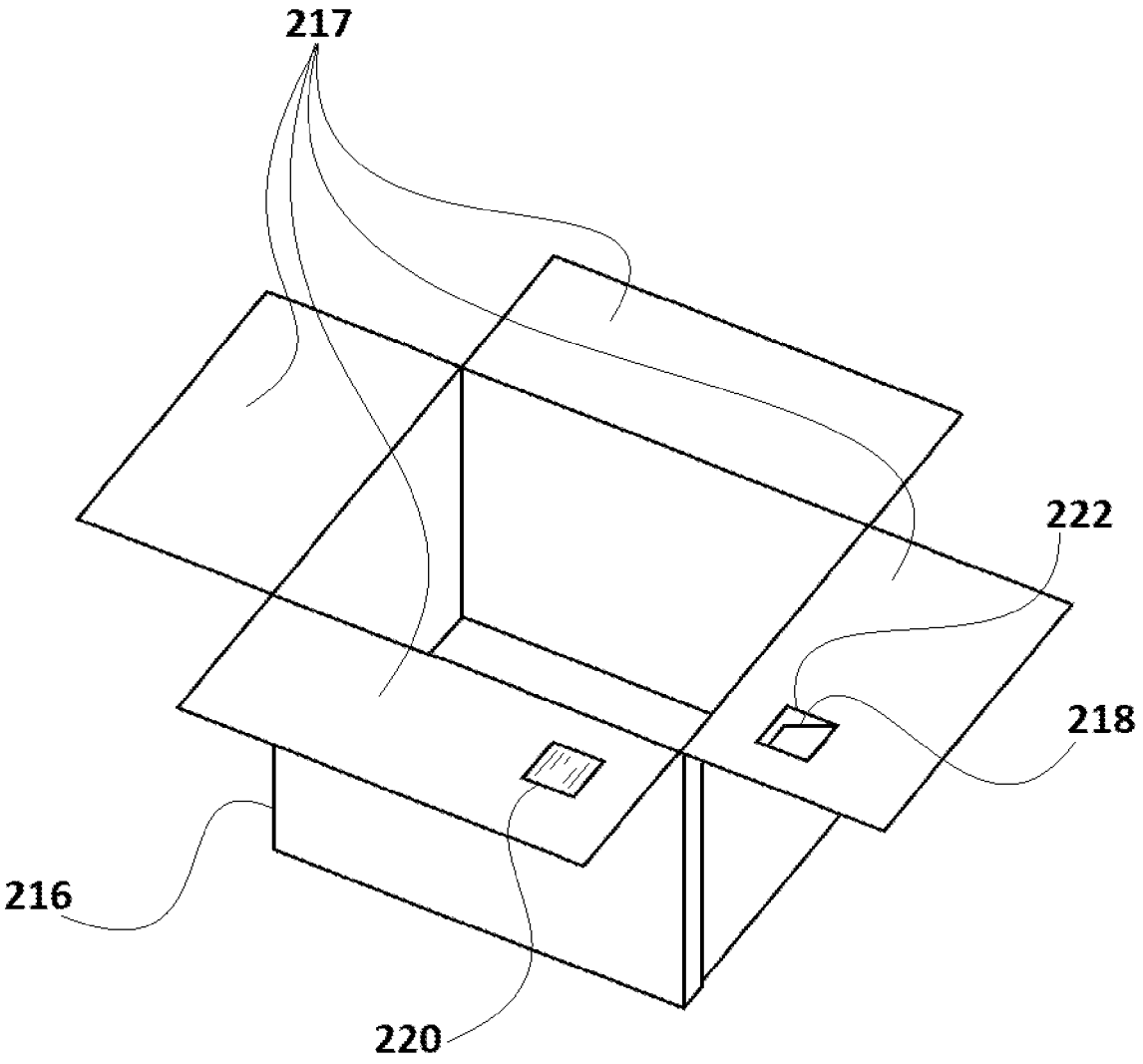
FIG. 5A is a perspective view of the outer box for the additional embodiment shown in FIGS. 4A and 4B.
Figure 5B:
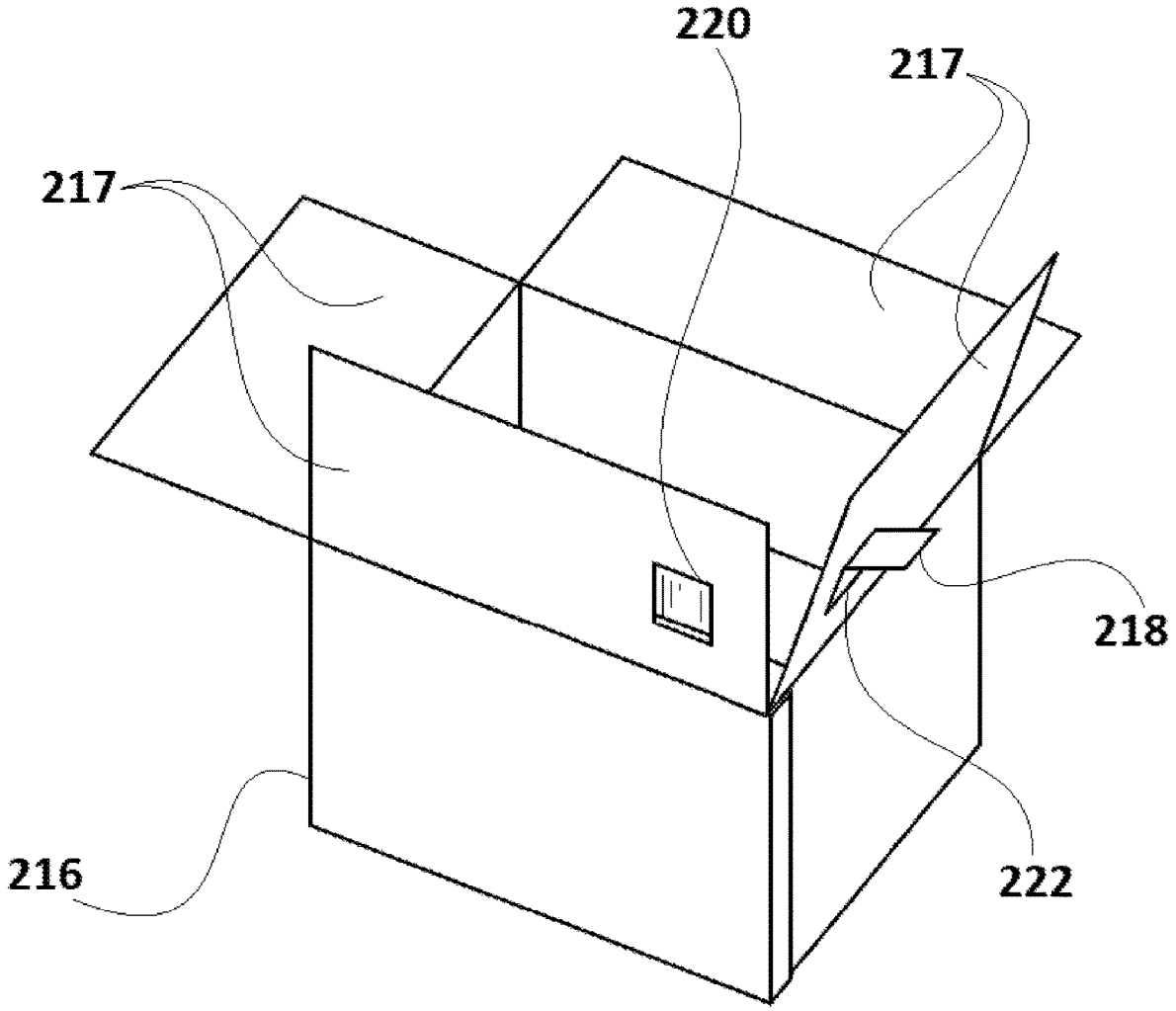
FIG. 5B is a perspective view of the outer box shown in FIG. 5A, with the upper flaps partially closed.
Figure 5C:
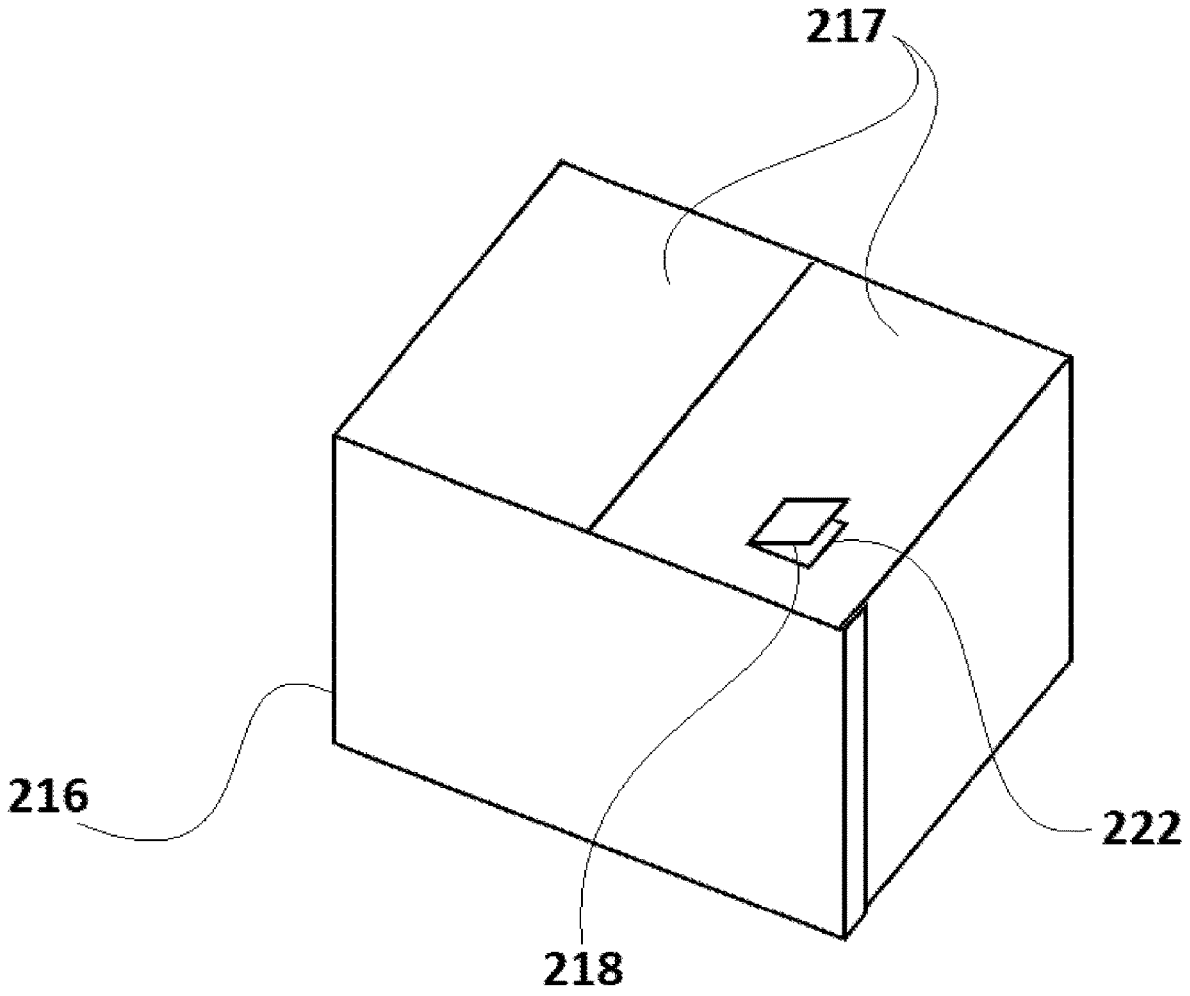
FIG. 5C is a perspective view of the outer box shown in FIG. 5A and FIG. 5B, with the upper flaps fully closed.

FIGS. 5A, 5B and 5C show an outer box 216 for the body 200 and lid 210. Outer box 216 is preferably corrugated cardboard, or substitutes including corrugated plastic sheets, e.g., those manufactured by Coroplast (Quebec, Canada), or wood, metal or another suitable protective material (for protection of the body 200). Of the four upper flaps 217 on outer box 216, one includes a cut-away window 220, which aligns under cut-away window 222, when flaps 217 are closed (FIG. 5C). Cut-away window 222 is preferably covered by a flap 218 cut into the lid 210, such that it can be folded open and closed.

The specific methods and compositions described herein are representative of preferred embodiments and are exemplary and not intended as limitations on the scope of the invention. Other objects, aspects, and embodiments will occur to those skilled in the art upon consideration of this specification, and are encompassed within the spirit of the invention as defined by the scope of the claims. It will be readily apparent to one skilled in the art that varying substitutions and modifications may be made to the invention disclosed herein without departing from the scope and spirit of the invention. The invention illustratively described herein suitably may be practiced in the absence of any element or elements, or limitation or limitations, which is not specifically disclosed herein as essential. Thus, for example, in each instance herein, in embodiments or examples of the present invention, any of the terms "comprising", "including", containing", etc. are to be read expansively and without limitation. The methods and processes illustratively described herein suitably may be practiced in differing orders of steps, and that they are not necessarily restricted to the orders of steps indicated herein or in the claims. It is also noted that as used herein and in the appended claims, the singular forms "a," "an," and "the" include plural reference, and the plural include singular forms, unless the context clearly dictates otherwise. Under no circumstances may the patent be interpreted to be limited to the specific examples or embodiments or methods specifically disclosed herein. Under no circumstances may the patent be interpreted to be limited by any statement made by any Examiner or any other official or employee of the Patent and Trademark Office unless such statement is specifically and without qualification or reservation expressly adopted in a responsive writing by Applicants.

The invention has been described broadly and generically herein. Each of the narrower species and subgeneric groupings falling within the generic disclosure also form part of the invention. The terms and expressions that have been employed are used as terms of description and not of limitation, and there is no intent in the use of such terms and expressions to exclude any equivalent of the features shown and described or portions thereof, but it is recognized that various modifications are possible within the scope of the invention as claimed. Thus, it will be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

What is claimed is:

1. A smart thermal insulation box consisting essentially of:

an insulated box having a top, a bottom and sides, each formed of one of eight panels of expanded polystyrene with mating mitered edges;

an outer corrugated box with a top, a bottom and sides which overlay the respective top, bottom and sides of the insulated box, and wherein the outer corrugated box is configured to accommodate the insulated box;

temperature and humidity sensors positioned inside the insulated box and electrically connected with an externally viewable display panel showing the temperature and humidity detected by the sensors, wherein components associated with operating the display panel reside in a first of the eight panels, where said first panel faces the top of the box, and where the top of the corrugated box has a window configured to overlay the display panel; and a refrigerant container positioned on the outer side of one side of the corrugated box, which, based on input from the sensors indicating temperature and humidity inside the insulated box exceeds a threshold, refrigerant enters into the insulated box.

2. The smart thermal insulation box of claim 1 wherein the temperature and humidity sensors are fixed in a recess with mating hook and loop fasteners in one of the side panels of the insulated box.

3. The smart thermal insulation box of claim 1 wherein the temperature and humidity sensors reside on a single pad having one portion of a mating hook and loop fastener.

4. The smart thermal insulation box of claim 1 further including piping connecting the refrigerant container to an inner portion of the insulated box wherein the sensors control a valve which is positioned in the piping.

5. The smart thermal insulation box of claim 1 wherein said components include a processor board, a beeper for providing audible alarms and an LCD or LED display screen for displaying the temperature and humidity detected by the sensors.

6. The smart thermal insulation box of claim 5 wherein the processor board includes a microprocessor, having memory and associated circuitry for sensing outputs from the sensors and displaying the temperature and humidity on the display screen.

7. The smart thermal insulation box of claim 1 wherein the corrugated box is cardboard or plastic.

8. The smart thermal insulation box of claim 1 wherein the window in the corrugated box is capable of being opened.

9. The smart thermal insulation box of claim 1 wherein the window in the corrugated box is clear plastic.

* * * * *